United States Patent [19]

Yao et al.

[11] Patent Number: 4,588,427

[45] Date of Patent: May 13, 1986

[54] METHOD AND APPARATUS FOR PURIFICATION OF HIGH $N_2$ CONTENT GAS

[75] Inventors: Jame Yao; Jong J. Chen; Douglas G. Elliot, all of Houston, Tex.

[73] Assignee: DM International Inc., Tulsa, Okla.

[21] Appl. No.: 711,368

[22] Filed: Mar. 13, 1985

[51] Int. Cl.[4] ..... F25J 3/02

[52] U.S. Cl. ..... 62/17; 55/68; 55/73; 62/20

[58] Field of Search ..... 62/17, 20; 55/68, 73; 208/350

[56] References Cited

U.S. PATENT DOCUMENTS 2,475,957 8/1944 Gilmore .
2,595,284 5/1952 Mullins .
2,600,494 6/1952 Ferro, Jr. .
2,603,310 7/1952 Gilmore .
2,716,332 4/1950 Haynes .
2,744,394 5/1956 Newton .
3,894,856 7/1975 Lofredo .
4,293,322 10/1981 Ryan et al. ..... 62/20
4,352,685 10/1982 Swallow .

*Primary Examiner*—Frank Sever
*Attorney, Agent, or Firm*—Bernard, Rothwell & Brown

[57] ABSTRACT

Nitrogen and methane are separated in a nitrogen-methane cryogenic fractionator operating at a temperature between the boiling points of nitrogen and methane. A distillative aid or absorbent is injected into the nitrogen-methane cryogenic fractionator for enhancing separation, for enabling an increase in operating pressure, and for enabling a high separation rate at relatively high temperature.

11 Claims, 5 Drawing Figures

34
60
S.R.
COLD
S.R.
20
74
70
59
50
62
54
63
56
52
58
DEC I
22

148
130
90
128
42
136
134
36
142
132
185
84
88
34
138
77
184
80
N.F. COLD
S.R.
74
183
82
76
78
185
S. R.
COLD
S. R.
N. S.
REBOILER
N.F.
RE-
BOILER
N.F.
WARM
S.R.
140
20
148
186
187
60
70
178
170
174
50
72
62
172
79
54
64
176
92
N2/C1
FRACTIONATOR
(N.F.)
182
52
180
63
102
100
DEC I
NITROGEN STRIPPER(N.S.)
118
SOLVENT
REGENERATOR
(S.R.)
22
C2+

METHOD AND APPARATUS FOR PURIFICATION OF HIGH $N_2$ CONTENT GAS

TECHNICAL FIELD

This invention relates to methods and apparatus for removing nitrogen from hydrocarbon gases such as natural gas, and is particularly useful in enhanced oil recovery processes wherein the associated gas recovered with the oil includes a substantial portion of nitrogen injected into the underground oil-bearing formation.

BACKGROUND ART

Natural gas, that is a mixture of methane and small amounts of higher molecular weight hydrocarbons from gas and oil wells, often contains a substantial portion of nitrogen. In situ under high formation pressure, hydrocarbon gases are either compressed into liquids or are dissolved in the heavier liquid hydrocarbon fractions. When natural gas is recovered from oil wells primarily concerned with oil production, the gases are said to be "associated" with the liquid fractions. As pressure is released during recovery, compressed gases or dissolved associated gases, are released to form a gas at the well head which, when free of excessive quantities of nitrogen and other contaminants, is suitable for being processed and used or sold as fuel or chemical feedstock. The nitrogen may occur naturally and/or may result from gas injections used to enhance oil recovery. In such oil recovery enhancement, nitrogen is injected at selected locations in an oil field formation to drive otherwise unrecoverable oil to the production well or wells. As the wells age, the nitrogen constituent of associated gas can increase up to 80 mole % or more of the total associated gas recovered from the well. When the nitrogen content exceeds 5 mole % or more of the natural gas, the heating value or chemical feedstock value of the gas is reduced, and the cost of gas compression, gas transport, and other gas handling is greatly increased relative to the usable portion of the gas.

The prior art contains many processes and apparatus for reducing the portion of nitrogen and other contaminants in natural gas in order to increase the value of the gas and to reduce costs. Generally the prior art removes the non-nitrogen contaminants and separates the higher boiling hydrocarbon components from the low boiling components consisting of nitrogen and methane prior to using one of two techniques, cryogenic condensation or cryogenic absorption, to separate methane from nitrogen. The separation processes are desirably performed at the highest practical pressures, well head pressure or pipeline pressure which can be up to 1,090 psia (75 bar), in order to reduce compression costs resulting from pressure reductions necessary for the separation processing. Minimizing refrigeration loads and fluid compression loads are likewise considered important to achieve ma imum efficiency.

Cryogenic condensation techniques for condensing methane from a gas mixture of methane and nitrogen employ refrigeration units or "cold boxes" to produce condensation temperatures, and employ distillation type apparatus to obtain maximum conversion and separation of gaseous nitrogen and liquid methane. These prior art condensation processes are generally limited to operation at a maximum pressure of about 400 psia (27 bar) since the efficient formation of separable liquid and gas phases occur well below the critical pressure which, in the nitrogen and methane mixture, is in the range from 500 to 730 psia (34 to 50 bar), with the minimum being on the pure nitrogen side. This limitation with a high input pressure, results in increased compressor duty to bring the methane back up to pipe line pressure. Also the prior art required the lowest effective temperatures above the boiling point of nitrogen for efficient condensation. Typically, condensation temperatures below −240° F. (−150° C.) are employed. Refrigeration duty to achieve such temperatures is sufficiently high to constitute a substantial cost factor in the separation. Additionally, some nitrogen condensation occurs at these temperatures resulting in significant limitations upon the maximum rectification and separation of methane and nitrogen that can be achieved by cryogenic distillation. Further, traces of carbon dioxide present in the associated gas may freeze out at these low temperatures, resulting in clogging of the condensation and distillation apparatus.

Cryogenic absorption processes, as exemplified in U.S. Pat. Nos. 2,603,310 and 2,744,394, employ liquid absorbents such as ethane, propane, propylene, ethylene, and pentane to preferentially absorb methane from the gaseous mixture of methane and nitrogen. This absorption is generally performed in an absorption tower at a relatively high pressure and with a cooled absorbent, and then the absorbed methane is released in a demethanizer or regenerator tower by heating the circulating stream of liquid absorbent at a reduced pressure. Absorption processes have the advantage that separation occurs at a much higher temperature, e.g., −40° to −70° F. (−40° to −55° C.), compared to condensation processes. Additionally higher processing pressures can be employed; the above mentioned U.S. Pat. No. 2,744,394 discloses that a pentane absorbent increases the critical pressure to enable producing an overhead nitrogen-rich gas stream, a side methane-rich stream and a bottom liquid pentane with absorbed methane stream at pressures exceeding 1,000 psia (69 bar). However, absorption processes require a high absorbent circulation rate to attain a sufficiently high methane/nitrogen separation. This high absorption circulation rate results in relatively high capital and operating cost caused by a high refrigeration requirement for the absorbent, high pumping horsepower, large fluid handling equipment, and substantial absorbent loss.

SUMMARY OF THE INVENTION

The present invention is summarized in a method and apparatus for separating nitrogen from methane in a gaseous mixture of nitrogen and methane wherein the gaseous mixture is cooled to a temperature below the boiling point of methane but above the boiling point of nitrogen, the cooled mixture is fed into a nitrogen-methane cryogenic fractionator, a liquid distillative aid selected from ethane, propane, isobutane, normal butane, or mixtures thereof is injected into the fractionator as a reflux flow, a bottoms fraction of distillative aid and liquid methane is withdrawn from the fractionator and passed to a regenerator where the liquid methane and distillative aid are heated and separated by methane evaporation, and the distillative aid from the regenerator is cooled and recycled to the distillation column.

An object of the invention is to provide a less costly and an improved process for removing nitrogen from hydrocarbon gases such as natural gas.

Another object is to improve condensation techniques for separating methane from nitrogen by utilizing an absorbent material as a distillative aid.

One advantage of the invention is that the presence of an absorbent or distillative aid in a nitrogen-methane distillation tower results in a greatly increased critical pressure for the mixture therein to reduce recompression costs for the product gas or gases.

Another advantage of the invention is that the presence of a distillative aid enables efficient methane condensation at substantially higher temperatures then has been possible in the prior condensation procedures.

One feature of the invention is that a very low circulation rate for distillative aid is possible since removal of methane occurs at condensation temperature where absorption is not limited by maximum absorptive capacity of the distillative aid.

Other objects, advantages and features of the invention will be apparent from the following description of the preferred embodiments taken in conjunction with the accompanying drawings.

DESCRIPTION OF THE PREFERRED EMBODIMENTS

Figure 1:
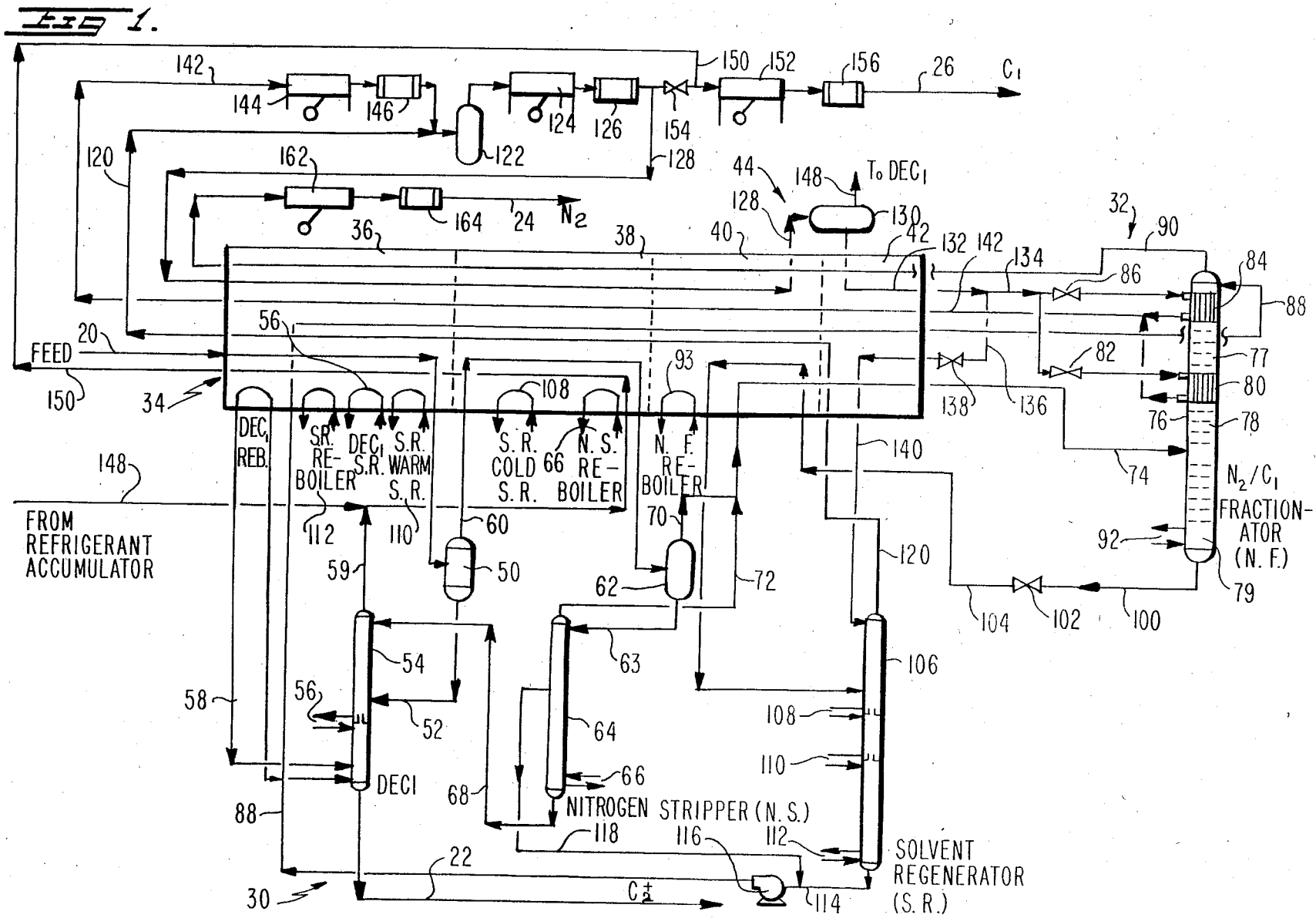
FIG. 1 is a schematic flow diagram of an apparatus and process for removal of nitrogen from a natural gas in accordance with the invention.

As illustrated in FIG. 1, the invention is embodied in a method and apparatus for separating a mixture of nitrogen and hydrocarbon gases in an input stream 20 into a stream 22 of high boiling hydrocarbons ($C_2$+), a stream 24 of nitrogen, and a stream 26 of methane. The high boiling stream 22 is separated from the nitrogen and methane in the feed 20 by condensing and distillation facilities indicated generally at 30 and then the methane and nitrogen are separated by a combination condensing, distillation and absorbent facility indicated generally at 32. Feedstreams to the facilities 30 and 32 are cooled by a cold box heat exchange facility indicated generally at 34 which includes successively colder sections 36, 38, 40 and 42 wherein the coldest section is cooled by methane refrigeration facilities indicated generally at 44 along with countercurrent cold streams which also along with reboiler streams provide cooling to warmer sections of the cold box. The methane-nitrogen separating facility 32 utilizes the combination of a cryogenic temperature below the methane boiling point, but well above the nitrogen boiling point, along with distillative aid contact for providing greatly improved economy and separation efficiency.

The feedstream 20 may be any hydrocarbon gas stream, such as an associated gas stream from an oil well, including methane and a substantial portion of nitrogen. Pressure of the stream 20 may be in the range from 300 to 1090 psia (16.5 to 75 bar). When well head gas contains substantial nonhydrocarbon contaminants, such as hydrogen sulfide or carbon dioxide, they are removed upstream from input 20. Preferably the entire plant is built to operate at the highest available pressure, plant inlet pressure less pressure drops through facilities in front. The illustrated apparatus and procedure is particularly adapted for removing the nitrogen from the associated gas of an oil well wherein the associated gas includes a nitrogen content in the range from 5 mole % to 80 mole %. The present system and procedure is believed to be particularly more tolerant to small amounts of contaminants in the feed, such as carbon dioxide, which can freeze at the cryogenic operating temperatures creating problems; the distillative aid tends to remove such contaminants, whereas processes employing condensation without any absorbent or distillative aid are much more susceptible to blockage and failure due to such contaminants.

The cold box 34 is an integral brazed aluminum structure which is designed to provide the desired heat exchange for proper cooling of input and distillative aid feed streams and corresponding heating of reboiler and desorption or distillation streams. The cold box is shown divided into the four sections 36, 38, 40 and 42 which correspond to several different successive colder temperature ranges. The temperatures of the individual streams entering and exiting each section will vary, generally from the warmest stream being on the left to the coldest being on the right.

The inlet gas stream 20 passes through the first section 36 of the cold box where the stream is cooled to a temperature within the range from about −35° F. to −55° F. (−37° C. to −48° C.). The design of this first cooling stage is selected to condense most of the ethane and heavier hydrocarbons in the feedstream. The condensed ethane and heavier hydrocarbons are separated from the remaining gas in separator 50 and fed by line 52 to demethanizer column 54. The liquid fed to the column 54 is heated by side reboiler 56 and bottom reboiler 58 in cold box section 36 to desorb methane which is absorbed within the liquid ethane and heavier hydrocarbons. The desorbed methane forms overhead stream 59. The reboiler operation of the demethanizer can be selected so that sufficient methane is removed to enable the bottoms stream 22 to meet natural gas liquids (NGL) specifications.

The noncondensed gases from the separator 50 in line 60 are fed to the next colder section 38 of the cold box for further cooling and condensation of ethane and heavier hydrocarbons. The cooling temperature is selected to be below about −100° F. (−73° C.) but above the temperature at which methane normally condenses at the existing inlet pressure. Liquid condensed in the stream 60 is separated by separator 62 and fed as reflux stream 63 to a nitrogen stripper column 64 operated under conditions for stripping nitrogen from the condensed liquid to maintain low absorbed nitrogen content so that stream 26 meets sales gas specification. Reboiler duty for the nitrogen stripper is provided by heat exchange 66 with the section 38. The bottoms stream 68 from the nitrogen stripper 64 is supplied as a reflux stream to the demethanizer 54.

Figure 2:
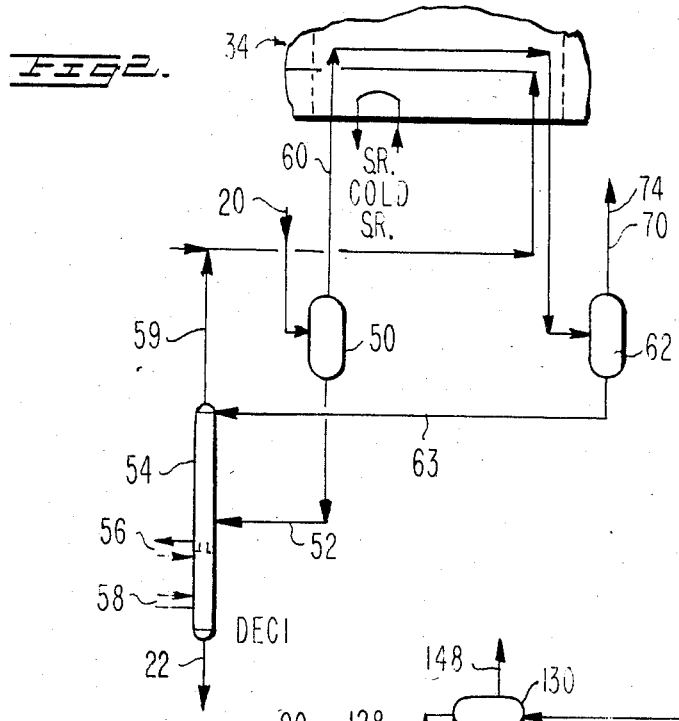
FIG. 2 is a schematic flow diagram of a modification of the process and apparatus of FIG. 1.

As shown in FIG. 2, the nitrogen stripper may be eliminated when the nitrogen content of the gas feed is less than 30 mole %. For these lower concentrations of nitrogen, the liquid bottoms stream 63 from the separator 62 is fed as the reflux stream to the demethanizer 54.

The gaseous overhead 70 from the separator 62 is combined with the overhead stream 72 from the nitrogen stripper, when the nitrogen stripper 64 (FIG. 1) is employed, and after further cooling in sections 40 and 42 of the cold box 34 to below the boiling point of methane, but above the boiling point of nitrogen, i.e., to a temperature in the range from about −190° to −200° F. (−123° to −130° C.), forms the input stream 74 to a nitrogen-methane fractionator column 76. The column 76 can be a standard distillation column with one overhead condenser 84 and one reboiler 92 and which is modified by injecting the distillative aid into the overhead condensers (only one condenser 84 shown) and one or more side reboilers (not shown in FIG. 1, but see FIG. 3). The reboiler 92 is coupled to cold box section 40. Generally the fractionator 76 includes an upper section 77, a middle or intermediate section 78 and a bottom section 79 with the inter-condenser 80 upstream from the inlet gas flow in the middle section 78, or between the upper and intermediate section. The inter-condenser 80 is a heat transfer device cooled by referigerant to remove heat from the upward flowing gas streams and downward flowing liquid stream of distillative aid and methane. The use of the inter-condenser produces more methane condensation at higher temperatures to save on refrigeration. Additionally, the inter-condenser permits a higher overhead condenser temperature and a lower distillative aid circulation rate. For a fixed amount of distillative aid circulation, higher intercondenser duties result in higher permissible overhead condenser temperatures. Preferably the operating temperatures of the inter-condenser and the overhead condenser are the same, for example about −210° F. (−134° C.) or above. Such higher temperatures, compared to the lower prior art condensing temperature of −240° F. (151° C.), raise the refrigerant compressor suction input by 3 to 4 times. The importance of using an inter-condenser increases in proportion to the nitrogen content of the feedstream. The use of more than one inter-condenser is normally required for a more thermally efficient plant design, especially at high nitrogen content. The overhead condenser 84 provides for rectification or a high degree of methane removal to produce a nitrogen gas overhead 90 of sufficient purity to reinject into the oil-bearing formation to enhance oil recovery.

Additionally a liquid distillative aid stream 88 is injected into the top of the upper section 77 to form a reflux flow in the column. The liquid distillative aid flows downward through the condensers 84 and 80 countercurrent to the gas flow. The distillative aid can be propane, ethane, isobutane, normal butane, or mixtures thereof. Trace amounts of iso- or normal-pentane can also be included in the distillative aid. In the bottom section 79 of the column 76 the methane and distillative aid mixture is heated by reboiler 92 to provide for desorption of nitrogen from the liquid phase. Distillative aid flow through the column is required if a reasonable separation between nitrogen and methane is expected at pressures above 400 psia (27 bar).

The nitrogen-methane fractionator 76 can be operated at substantially higher pressures than previous cryogenic condensation type fractionators. The prior art fractionators had to be operated at a pressure well below the critical pressure of nitrogen or below about 400 psia (27 bar) in order to obtain a satisfactory rate of formation of a liquid phase by condensing methane. The condensation fractionator 76 utilizing the reflux distillative aid stream 88 in the fractionator 76 can operate at substantially higher pressures, for example in the range from 400 to 1000 psia (27 bar to 70 bar). The presence of the absorbent in the fractionator results in a substantially higher critical pressure in the fractionator to enable forming of separate liquid and gas phases of the methane and nitrogen, respectively, at the higher pressures.

Additionally the distillative aid contributes to permitting the fractionator tower 76 to operate at the significantly higher temperature than is possible with prior art nitrogen-methane condensation fractionators since condensation is aided by the distillative aid. In prior art condensation fractionators, the temperature was set as low as possible, i.e. −240° F. (−150° C.), in order to obtain a satisfactory methane condensation rate while avoiding excessive nitrogen condensation. Some nitrogen tends to condense out at these low temperatures which approach the boiling point of nitrogen. Since removal of methane from the nitrogen is assisted by the distillative aid as well as the inter-condenser, the temperature in the fractionator tower can be substantially higher, e.g., −210° F. (−134° C.) in order to avoid substantially all nitrogen condensation. A further advantage of the employment of the distillative aid is increased tolerance to carbon dioxide in the input stream. Carbon dioxide solubility is increased in the cold nitrogen-methane mixture when the distillative aid, $C_2$, $C_3$ or $C_4$, is present. This, together with the higher operating temperature, reduces the risk of blockage due to frozen carbon dioxide.

The bottoms from the fractionator tower 76 consisting of a mixture of liquid distillative aid and liquid methane are withdrawn in line 100 and passed through a hydraulic turbine or a Joule-Thompson valve 102 to line 104 to reduce the pressure to a pressure in the range from about 130 to 160 psia (9 bar to 11 bar), for example, 150 psia (10 bar). Stream 104 then passes countercurrently through cold box section 40 to heat the stream from about −156° F. (−104° C.) to −130° F. (−90° C.) before passing to the inlet of a solvent regenerator tower 106. The solvent regenerator tower has a cold side reboiler 108, a warm side reboiler 110 and a bottom reboiler 112 coupled to cold box sections 38 and 36 to convert the liquid methane to gas and to desorb methane from the absorbent or distillative aid. The distillative aid is withdrawn in bottoms stream 114 which is then pumped by pump 116 to line 88 which passes through cold box sections 36, 38, 40 and 42 back to the absorbent injection input of the fractionator tower 76. Makeup absorbent is added to line 114, for example by withdrawing a stream 118 from an appropriate tray in the nitrogen stripper 64 and adding to the line 114.

The circulation rate for the distillative aid 88 is selected as a function of both the concentration of methane in the feed stream 74 and the operating pressure of the fractionator 76. Distillative aid circulation is inversely related to methane content, and is proportionally related to pressure in the fractionator. Generally the distillative aid circulation rate will be less than 50 mole % of input feed 74 at 1000 psia (69 bar) and at low methane content input, and will be less than 35 mole % at 300 psia (21 bar) and higher methane content input. Distillative aid circulation is changed inversely in proportion to methane content to dampen liquid loading variations of the fractionator resulting from normal methane content variation such as may occur in enhanced oil recovery operations. Distillative aid circulation rate is also set in accordance with operating pressure to insure adequate distillative aid presence to obtain a suitable critical pressure to produce a high methane condensation rate.

The circulation rate for the distillative aid is much lower than absorbent recirculation rates required for absorbent type nitrogen-methane separators. Prior art absorption separators require a high circulation rate since methane absorption in the absorbent is limited and thus the absorbent must be constantly regenerated at a relatively rapid rate to insure efficient removal of methane from the nitrogen-methane gas stream. The present invention operates at a temperature low enough where methane forms a stable liquid; thus the quantity of methane which is mixed with the distillative aid is unlimited. Methane absorption by the distillative aid, particularly in the upper section 77 and condenser 84 of the fractionator 76, does substantially aid in removal of methane from the nitrogen to produce substantially greater nitrogen-methane separation than is normally produced in most prior art installations. At least a portion of the reflux stream in the fractionator is formed by methane absorption in the distillative aid which is more energy efficient than condensation; removing sensible heat of solvent is more energy efficient than removing heat of vaporization to produce reflux. This reduces low temperature condenser duty and the refrigeration load for the condenser.

The methane overhead 120 is passed countercurrently through sections 40, 38, 36 of the cold box 34 to cool incoming feed and refrigerant streams with the methane stream 120 being heated to about 107° F. (41° C.). The low pressure refrigerant gas from the condensers 80 and 82 is passed in line 142 countercurrently through the sections 42, 40, 38 and 36 of the cold box 34 and heated to about 107° C. Compressor 144 compresses the refrigerant from line 142 to about 147 psia (10 bar) and passes it through heat exchanger 146 to be added, at a temperature of about 117° F. (47° C.), to the stream 120 to accumulator 122. From accumulator 122, the methane is withdrawn and compressed by compressor 124 to a pressure of about 375 psia (26 bar) and passed through heat exchanger 126 where it is cooled to about 117° F. (47° C.). A portion, from 20 to 80% or more depending inversely upon the methane concentration in the input 20, of the compressed methane is passed in line 128 through sections 36, 38 and 40 to precool the methane to about −150° F. (−101° C.) by heat transfer to reboiler streams, and countercurrent refrigeration and product streams to partially condense the methane. The liquid portion of the refrigerant stream 128 is accumulated in separator 130. Liquid stream 132 from separator 130 is subcooled to about −190° F. (−123° C.) in section 42 of the cold box 34 before it is split into two streams 134 and 136. Stream 134, about 65% of stream 132, is adiabatically flashed to about 82 psia (6 bar) by the Joule-Thompson valves 82 and 86 which supply refrigeration duties for the inter-condenser 80 and the overhead condenser 84 of the nitrogen-methane fractionating tower 86. Stream 136 is flashed to about 153 psia (11 bar) by Joule-Thompson valve 138 in line 140 to provide cooling duty for cold section 42 of the cold box to subcool input stream 74, the distillative aid stream 88 and methane refrigerant stream 132. A reasonable amount of liquid is maintained in refrigerant stream 140 from the valve 138 for refluxing the solvent regenerator 106.

The methane refrigerant includes small amounts of nitrogen, ethane, propane, isobutane and normal butane. The quantity of nitrogen and $C_2+$ hydrocarbon components are controlled by the operating factors of the high boiling point removing facilities and the nitrogenmethane separation facilities to enhance the condensation of the methane-rich refrigerant so that condensation can occur in the range from −140° F. to −150° F. (−96° C. to −101° C.) without greatly reducing refrigerant flash pressure.

Integration of refrigeration and regenerator operation enables substantially improved efficiency. The regenerator 106 operates between the intermediate refrigerant compression and flash pressures so that regenerator reflux 140 can be supplied by unvaporized refrigerant, and methane vapor overhead 120 can supply refrigerant vapor input to the final refrigerant compressor stage 124. Additionally reboiler and side reboiler duties of the fractionator 76 and the regenerator 106 along with other reboiler and countercurrent heat exchanger streams provide for efficient cooling and condensation of compressed refrigerant stream 128.

The overhead from the separator 130 in line 148 is combined with the overhead 59 from the demethanizer 54 to form stream 150 which is passed to the suction inlet of a compressor 152. Excess methane from the refrigerant line 128 is applied through pressure adjusting valve 154 for combining with stream 150. Compressor 152 compresses the stream 150 and passes the compressed methane through heat exchanger 156 to the methane product line 26 at pipeline pressure.

The nitrogen overhead 90 is also returned through the sections 42, 40, 38 and 36 of the cold box 34 to cool incoming streams. Compressor 162 compresses the nitrogen and passes it through heat exchanger 164 to nitrogen product line 24. This compresed nitrogen product can be utilized for reinjection into the underground oil-bearing formation to enhance oil recovery.

The present cryogenic distillation system using distillative aid injection results in compression savings up to about 30% compared to prior art cold box condensation technologies. Due to the higher suction pressure of the methane rich stream 142 and due to the high pressure methane-nitrogen distillation operation, the number of total compression stages is reduced to four, three for methane (compressors 146, 126 and 152) and one for nitrogen (compressor 162), compared with prior art cryogenic condensation techniques which require six or more compression stages. These savings in capital and operating costs of compression more than offset the extra costs for the solvent regenerator. Further the solvent regeneration facilities, due to the low distillative aid circulation rate, is substantially less costly than regeneration facilites in prior art absorption processes wherein the high absorbent circulation rates demanded relative large and expensive facilities to handle the cooling, heating and circulation of the large absorbent flow.

Figure 3:
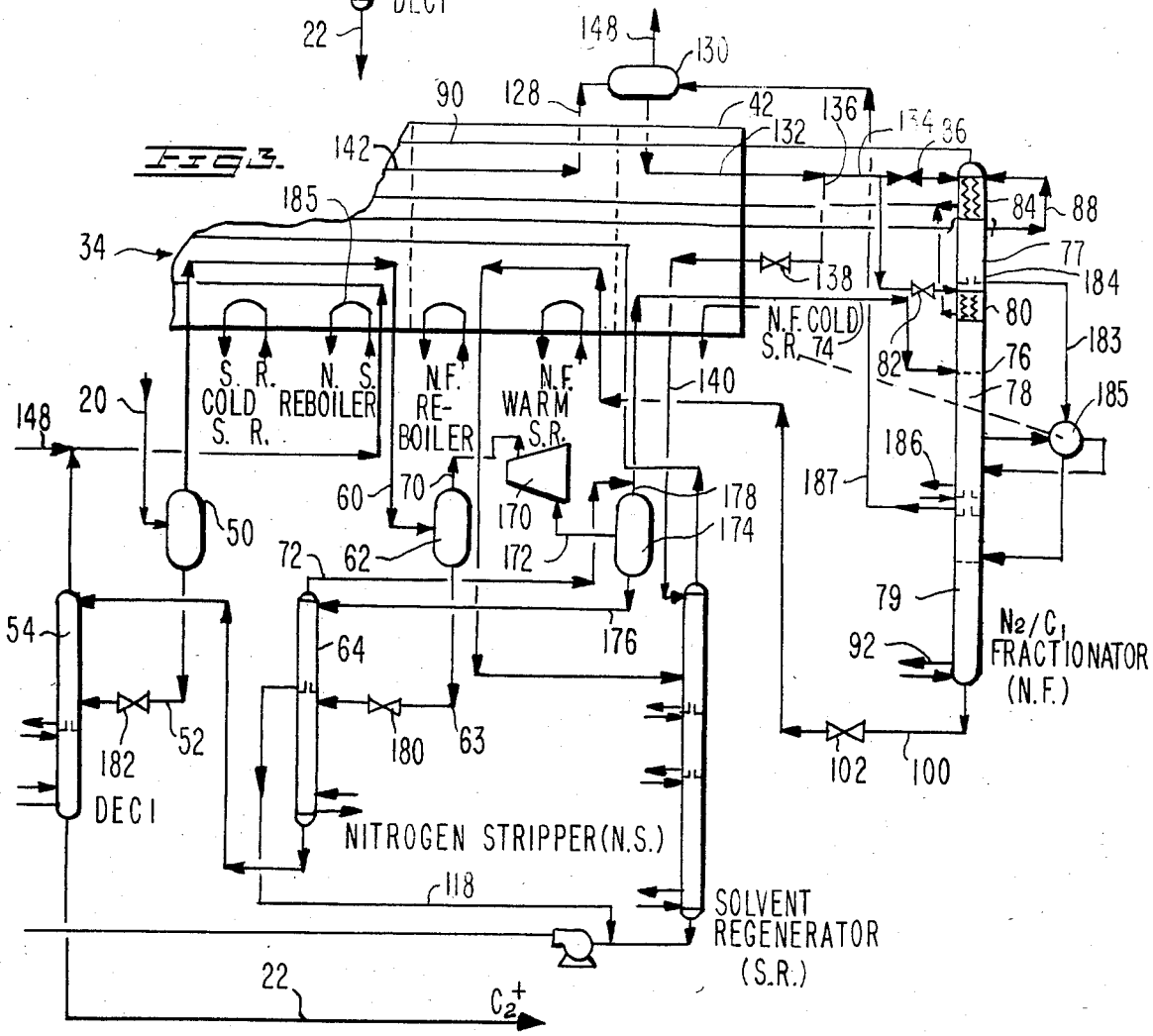
FIG. 3 is a schematic flow diagram of another modification of the process and apparatus of FIG. 1.

The modification of FIG. 3 illustrates adoption of the process and apparatus to a plant employing a turbo expander 170 which can be used to drive an electric generator, a compressor, or other apparatus. The nitrogen-methane stream 70, after removal of higher boiling components, is flashed by the turbo-expander 170 to an intermediate pressure in the range from 300 to 400 psia (20 to 28 bar) to produce a partially condensed stream 172. The stream 172 passes to separator 174 where the methane liquid stream 176 is separated from the gas overhead stream 178. The liquid stream 176 is used as a reflux stream for the nitrogen stripper 64; the liquid stream 63 from the separator 62 being changed to pass through a Joule-Thompson valve 180 to a feed inlet of the nitrogen stripper 64 wherein the valve 180 reduces the pressure to the intermediate pressure. Also the methane stripper 54 will be operated at the intermediate pressure; a Joule-Thompson valve 182 is inserted for proper pressure reduction in the feed 52 for the methane stripper column 54. The overhead stream 178 from the separator 174 is combined with the nitrogen stripper overhead 72 to form the feed 74 to the nitrogen methane fractionator 76.

With the expander 170 reducing the methane-nitrogen stream to a pressure from 300 to 400 psia (20 to 28 bar), the cryogenic distillation column 76 may be modified by using a bypass 183 to direct the distillative aid from a chimney tray 184 in the lower portion of the upper section 77 through cold side reboiler heat exchange 185 in cold box section 42 to the lower section 79. The bypass 183 is particularly suitable when the methane content of feed 74 is greater than 40 mole % of the feed; for lesser methane content feeds, methane removal is enhanced by distillative aid flow through the column length. With this bypass modification, methane is condensed in the middle section 78 without the distillative aid. This liquid methane can be circulated through the cold side heat exchanger 185 and a warm side reboiler 186 to remove absorbed nitrogen, and then can be withdrawn through lines 187 to the refrigerant accumulator 130 to reduce methane refrigeration compressor load. The modification of FIG. 3 will have increased methane pump up costs due to the pressure reduction through turbo expander 170; however, the overall efficiency in condensation separation of nitrogen from methane using a distillative aid is still an improvement when compared to prior art plants employing turbo expander facilities.

Figure 4:
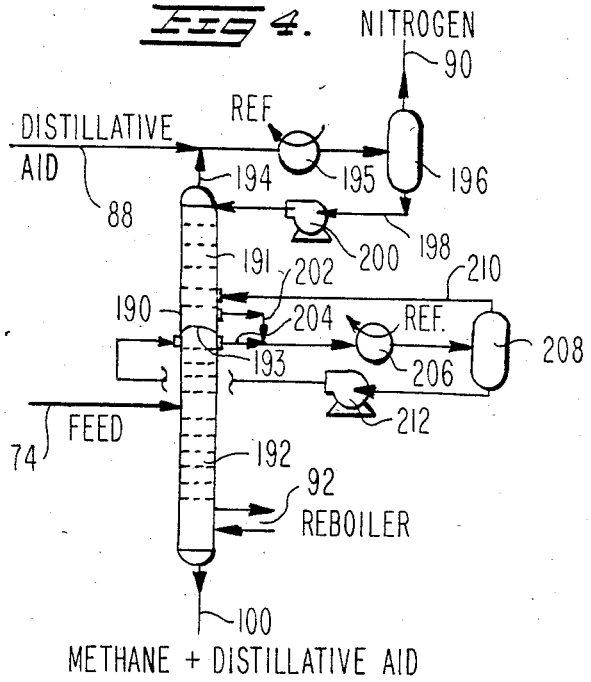
FIG. 4 is a schematic flow diagram of a variation of a distillation procedure and device of FIG. 1.
Figure 5:
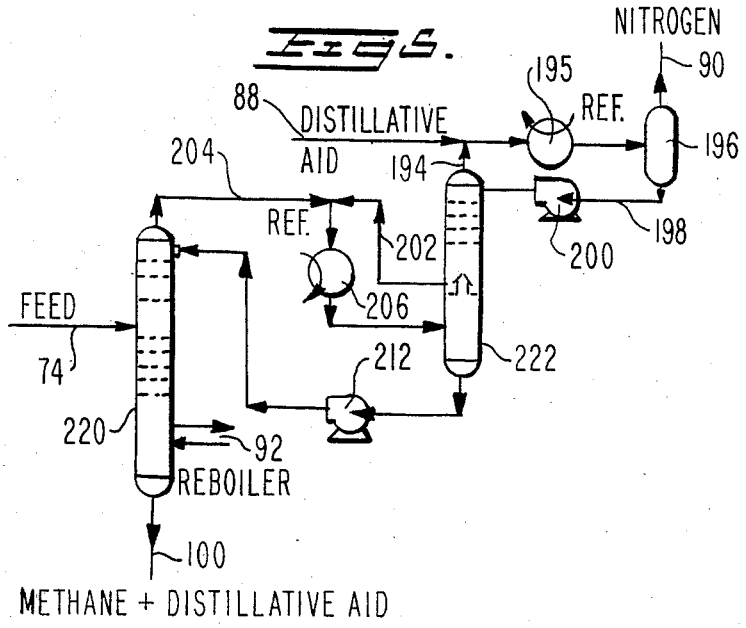
FIG. 5 is a schematic flow diagram of another variation of the distillation procedure and device of FIG. 1.

Additional variations of the nitrogen-methane cryogenic distillation facility are shown in FIGS. 4 and 5. The inter-condensers 80 of FIGS. 1 and 3 are shown as being mounted in the fractionator column. However, in FIGS. 4 and 5 inter-condensers 206 external to the fractionator column or columns are employed along with overhead condensers 195 external to the columns. The fractionator column 190 of FIG. 4 is separated into upper and lower sections 191 and 192 by an internal wall 193. The overhead 194 of the upper section 191 is mixed with the distillative aid stream 88 and passed to the overhead condenser 195 cooled by an expanded refrigerant stream. A separator 196 separates the liquid output of the cooler 195, distillative aid plus condensed and absorbed methane, from the gas component, nitrogen 90. The liquid component 198 is returned by pump 200 to the reflux input of the upper section of the column 190. Liquid stream 202 from the bottom of the upper column section 191 is mixed with overhead stream 204 from the lower section and passed to the inter-condenser 206 cooled by expanded refrigerant. Separator 208 separates the liquid and gas output of the cooler 206, passing the gas stream 210 back to the upper section 191 and passing the liquid stream by pump 212 as reflux to the lower section 192. The variation of FIG. 4 can be used with a wider range of pressures and nitrogen content inputs due to the complete barrier separation of the upper and lower sections.

In the variation of FIG. 5, the fractionator has two columns 220 and 222 forming the lower, intermediate and upper fractionator sections with the column 220 receiving the feed 74. The column 220 functions as a distillation column with a bottom reboiler 92 similar to the lower section of FIG. 4. The liquid stream 202 is drawn from the chimney tray of the column 222 for mixing with the overhead stream 204 from column 220 and passing through the condenser 206 to the separator or lower section of column 222. The liquid bottom stream from column 222 is passed by pump 212 as reflux to the column 220.

Since many modifications, variations and changes in detail may be made to the above described embodiment, it is intended that all matter shown in the accompanying drawings and described above be interpreted as illustrative of the invention and not limiting upon the scope and spirit of the invention as defined in the following claims.

What is claimed is:

1. A method for separating nitrogen from methane in a gaseous mixture including nitrogen and methane, comprisng the steps of cooling the gaseous mixture to a temperature below the boiling point of methane but above the boiling point of nitrogen, feeding the cooled mixture to a nitrogen-methane cryogenic fractionator to provide methane condensation, injecting into the fractionator a distillative aid including a liquid material selected from the group consisting of ethane, propane, isobutane, normal butane and mixtures thereof to increase the critical pressure for the mixture sufficient to reduce product recompression costs, to increase the relative volatility of nitrogen to methane, and to aid condensation by absorbing a portion of the methane, passing a bottoms fraction from the nitrogen-methane cryogenic fractionator including a mixture of distillative aid and liquid methane to a regenerator, heating the mixture of distillative aid and liquid methane in the regenerator to form an overhead stream of methane and a bottoms fraction of distillative aid, cooling and returning the bottoms fraction of distillative aid for the above injection into the nitrogen-methane cryogenic fractionator sufficient to provide condensation of methane which results in a reduced circulation rate for the distillative aid, withdrawing methane from the regenerator as product, and withdrawing nitrogen overhead from the nitrogen-methane cryogenic fractionator.

2. A method as claimed in claim 1 wherein the nitrogen-methane cryogenic fractionator operates at a pressure in the range between 27 to 69 bar.

3. A method as claimed in claim 1 wherein the feeding of the cooled mixture to the nitrogen methane cryogenic fractionator includes feeding the mixture to an intermediate section of the fractionator, and further including condensing methane from the mixture by means of an inter-condenser interposed between an upper and the intermediate sections of the fractionator, and further condensing methane by means of an overhead condenser in the upper section of the fractionator.

4. A method as claimed in claim 3 wherein the injecting of the distillative aid includes injecting the distillative aid to pass countercurrent to the nitrogen overhead through the overhead condenser.

5. A method as claimed in claim 3 wherein the inter and overhead condensers are operated at a temperature of about −134° C.

6. A method as claimed in claim 1 for removing nitrogen from a natural gas mixture wherein there is included the step of removing ethane and heavier hydrocarbon gas material from the natural gas stream prior to feeding the cooled mixture of nitrogen and methane to the nitrogen-methane cryogenic fractionator.

7. A method as claimed in claim 1 including the steps of compressing and condensing a portion of the methane overhead from the regenerator for use as refrigerant, flashing a first portion of the refrigerant in condenser means within the nitrogen-methane cryogenic fractionator for removing heat of condensation and absorption of methane, partially flashing a second portion of the refrigerant in heat exchanger means to perform the cooling steps, and injecting an unflashed portion of the second portion of refrigerant as reflux into the regenerator.

8. An apparatus for separating nitrogen from methane comprising means for cooling the gaseous mixture of nitrogen and methane to a temperature below the boiling point of methane but above the boiling point of nitrogen, nitrogen-methane cryogenic factionator means for receivng the cooled mixture of nitrogen and methane, condenser means for condensing methane in the fractionator means, means for injecting a distillative aid including a material selected from the group consisting of ethane, propane, isobutane, normal butane and mixtures thereof as a reflux stream into the nitrogen-methane cryogenic fractionator means to increase the critical pressure for the mixture sufficient to reduce product recompression costs, means for withdrawing a mixture of distillative aid and liquid methane from a bottom of the cryogenic nitrogen-methane fractionator means, a regenerator for receiving the withdrawn mixture of distillative aid and liquid methane to heat the mixture to drive off methane as overhead and produce a lean distillative aid bottoms product, and means for cooling and recirculating the lean distillative aid from the regenerator to the nitrogen-methane cryogenic fractionator means for providing condensation of methane which results in a reduced circulation rate for the distillative aid.

9. The apparatus of claim 8 wherein the condenser means of the nitrogen-methane cryogenic fractionator means includes an inter-condenser for condensing bulk methane from the feedstream, and an overhead condenser for receiving a flow of regenerated distillative aid and for condensing further methane from the gaseous stream.

10. The apparatus of claim 9 for separating nitrogen from a natural gas stream including means for separating ethane and heavier hydrocarbons from the cooled mixture prior to the nitrogen-methane cryogenic fractionator.

11. The apparatus of claim 8 including means for compressing and condensing a portion of the methane overhead from the regenerator into refrigerant, means for flashing a first portion of the refrigerant in the condenser means of the fractionator to remove heat of condensation and absorption of methane, said gaseous mixture cooling means and said distillative aid cooling means including cold box heat exchange means, means for partially flashing a second portion of the refrigerant in the cold box heat exchange means to provide a portion of the cooling duty thereto, and means for injecting an unflashed second portion of the second portion of refrigerant as reflux in the regenerator.

* * * * *